US010100613B2

(12) United States Patent
Urbanski et al.

(10) Patent No.: US 10,100,613 B2
(45) Date of Patent: Oct. 16, 2018

(54) SUBWATER HEAT EXCHANGER

(71) Applicants: Nicholas F. Urbanski, Katy, TX (US); Robert D. Denton, Bellaire, TX (US); Charles J. Mart, Baton Rouge, LA (US); Tracy A. Fowler, Magnolia, TX (US)

(72) Inventors: Nicholas F. Urbanski, Katy, TX (US); Robert D. Denton, Bellaire, TX (US); Charles J. Mart, Baton Rouge, LA (US); Tracy A. Fowler, Magnolia, TX (US)

(73) Assignee: ExxonMobil Upstream Research Company, Spring, TX (US)

( * ) Notice: Subject to any disclaimer, the term of this patent is extended or adjusted under 35 U.S.C. 154(b) by 512 days.

(21) Appl. No.: 14/766,621

(22) PCT Filed: Sep. 30, 2013

(86) PCT No.: PCT/US2013/062711

§ 371 (c)(1),
(2) Date: Aug. 7, 2015

(87) PCT Pub. No.: WO2014/130096

PCT Pub. Date: Aug. 28, 2014

(65) Prior Publication Data

US 2015/0354321 A1 Dec. 10, 2015

Related U.S. Application Data

(60) Provisional application No. 61/768,262, filed on Feb. 22, 2013.

(51) Int. Cl.
*E21B 36/00* (2006.01)
*F28D 15/00* (2006.01)
(Continued)

(52) U.S. Cl.
CPC ..... *E21B 36/001* (2013.01); *F28D 1/022* (2013.01); *F28D 1/047* (2013.01); *F28D 1/0435* (2013.01); *F28D 15/00* (2013.01); *F28F 2250/08* (2013.01)

(58) Field of Classification Search
CPC ..... F28D 1/0435; F28D 1/047; F28D 2015/0291; F28D 1/022; F04D 25/16; F04D 25/163; E21B 36/001; F25D 15/00
See application file for complete search history.

(56) References Cited

U.S. PATENT DOCUMENTS 1,576,833 A 3/1926 Larsen
2,184,837 A 12/1939 Hemming ..... 257/137
(Continued)

FOREIGN PATENT DOCUMENTS

FR 1078545 11/1954 ..... F04D 25/16
JP S60/80092 7/1985 ..... F28F 1/32
(Continued)

*Primary Examiner* — Tho V Duong
(74) *Attorney, Agent, or Firm* — ExxonMobil Upstream Research Company—Law Department

(57) ABSTRACT

The present disclosure provides a subwater heat exchanger that includes a duct, first coils, a first impeller and a second impeller. The duct is configured to receive a first fluid. The first coils are inside of the duct and are configured to receive a second fluid that is heated or cooled by the first fluid. The first impeller is inside of the duct that is configured to initiate flow of the first fluid around the first coils. The second impeller is inside of the duct and is substantially in line with the first impeller along a duct lateral axis of the duct.

21 Claims, 4 Drawing Sheets

(51) Int. Cl.

| | |
|---|---|
| ***F28D 1/04*** | (2006.01) |
| ***F28D 1/047*** | (2006.01) |
| ***F28D 1/02*** | (2006.01) |

(56) References Cited

U.S. PATENT DOCUMENTS

| | | | | |
|---|---|---|---|---|
| 2,570,247 | A * | 10/1951 | Wikals | 165/122 |
| 3,768,546 | A | 10/1973 | Shipes | 165/39 |
| 3,840,067 | A | 10/1974 | Bos | 165/1 |
| 3,856,078 | A * | 12/1974 | Dahl | 165/108 |
| 4,366,106 | A | 12/1982 | Benyak et al. | 261/156 |
| 5,180,003 | A | 1/1993 | Kouzel et al. | 165/121 |
| 5,800,316 | A | 9/1998 | Wahle et al. | 165/104.21 |
| 6,142,215 | A | 11/2000 | Paulsen et al. | 165/45 |
| 6,681,576 | B1 * | 1/2004 | Abe | 60/643 |
| 6,997,609 | B2 | 2/2006 | McCarthy | 378/200 |
| 7,554,223 | B1 | 6/2009 | Kay | 310/11 |
| 7,918,283 | B2 | 4/2011 | Balkanyi et al. | 166/344 |
| 8,256,519 | B2 * | 9/2012 | Friedemann | 166/335 |
| 8,430,556 | B2 | 4/2013 | Mostofi-Ashtiani | 165/158 |
| 8,638,004 | B2 | 1/2014 | Badger | 290/43 |
| 8,978,381 | B2 | 3/2015 | Hirshberg | 60/650 |
| 9,068,782 | B2 | 6/2015 | Kar et al. | 165/96 |
| 2007/0152452 | A1 * | 7/2007 | Finley et al. | 290/54 |
| 2010/0051253 | A1 | 3/2010 | Dickey | 165/247 |
| 2010/0206573 | A1 | 8/2010 | Paulus et al. | 166/335 |
| 2010/0252227 | A1 | 10/2010 | Sten-Halvorsen et al. | 165/45 |
| 2010/0281904 | A1 | 11/2010 | Yokomachi et al. | 62/271 |
| 2011/0100589 | A1 | 5/2011 | Van Der Rest | 165/45 |
| 2012/0091711 | A1 * | 4/2012 | Badger | 290/43 |
| 2012/0097362 | A1 * | 4/2012 | Kanstad et al. | 165/45 |
| 2012/0168142 | A1 | 7/2012 | Hernandez | 165/279 |

FOREIGN PATENT DOCUMENTS

| | | | |
|---|---|---|---|
| JP | 2001/003748 | 10/2001 | F01P 5/02 |
| JP | 2012/092808 | 5/2012 | A01D 41/12 |
| KR | 1993/0022045 | 4/1992 | F28D 7/10 |
| WO | WO2010/110676 | 9/2010 | E21B 37/00 |

* cited by examiner

| UNIT | A | B | C | D | E | F |
|---|---|---|---|---|---|---|
| Process | Condensing | Condensing | Condensing | Condensing | Condensing | Cooling |
| Duty (kW) | 936 | 58827 | 893 | 1601 | 1146 | 11227 |
| EMTD (°C) | 30.0 | 56.4 | 39.1 | 34.0 | 29.3 | 61.2 |
| Seawater Velocity (m/s) | 0.01 | 0.01 | 0.01 | 0.01 | 0.01 | 0.01 |
| Total Area ($m^2$) | 319 | 7310 | 365 | 536 | 346 | 2176 |
| Seawater Velocity (m/s) | 1.03 | 1.03 | 1.03 | 1.03 | 1.03 | 1.03 |
| Total Area ($m^2$) | 149 | 1959 | 231 | 273 | 122 | 824 |

SUBWATER HEAT EXCHANGER

CROSS REFERENCE TO RELATED APPLICATION

This application is the National Stage of International Application No. PCT/US2013/062711, filed Sep. 30, 2013, which claims the priority benefit of U.S. Provisional Patent Application 61/768,262 filed Feb. 22, 2013 entitled SUBWATER HEAT EXCHANGER, the entirety of which is incorporated by reference herein.

FIELD OF THE DISCLOSURE

The disclosed embodiments relate generally to a subwater heat exchanger.

BACKGROUND

This section is intended to introduce various aspects of the art, which may be associated with some of the disclosed embodiments. This discussion is believed to assist in providing a framework to facilitate a better understanding of particular aspects of the disclosed embodiments. Accordingly, it should be understood that this section should be read in this light, and not necessarily as admissions of prior art.

Subwater heat transfer offers substantial benefits for hydrocarbon production including, but not limited to (1) reduced flow assurance concerns, (2) reduced pipeline length and/or line sizing, (3) smaller topside facilities and (4) reduced energy loss from multiphase flow in lines. Subwater heat transfer refers to heat transfer within water where the water comprises, but is not limited to, seawater and/or lake water.

A variety of conventional subwater heat transfer structures exist. One structure includes a box-shaped, completely open-sided structure containing tubes or pipes (i.e., a coil or bundle). The tubes or pipes are parallel with the sea floor and supported at the ends and at numerous locations along their length. Fluid flowing through the tubes or pipes, i.e. process fluid, may be cooled or heated by seawater that enters the structure and flows through voids between neighboring tubes or pipes.

Another conventional subwater heat transfer structure is discussed in U.S. Published Application No. 2010/0252227 ("the '227 application"). The '227 application discloses a subsea cooling unit having an inlet for a hot fluid and an outlet for cooled fluid. The subsea cooling unit comprises coils exposed to seawater and a first propeller for generating a flow of seawater past the coils and through voids between neighboring coils.

Disadvantages of conventional subwater heat transfer structures relate to the velocity of the cooling/heating fluid that flows through the voids in each structure. The velocity of the cooling/heating fluid strongly dictates the thermal performance and size of the structure. The thermal performance of the structure is a function of the velocity of the cooling/heating fluid that flows through the voids. The velocity of cooling/heating fluid in conventional subwater heat transfer structures is not constant and is often small. For example, the cooling/heating fluid velocity may only range from 0.01 to 0.20 m/s. The non-constant nature of the cooling/heating fluid velocity prevents effective, steady-state performance of the structure and effective control of the outlet temperature of the process fluid that is cooled/heated by the cooling/heating fluid. Moreover, the lower velocity of the cooling/heating fluid affects the size of the structure. The lower the cooling/heating fluid velocity, the larger the heat transfer area must be for the structure to achieve a desired thermal performance. Increased cooling/heating fluid velocity (e.g., from 0.01 to 1.00 m/s instead of from 0.01 to 0.20 m/s) can decrease the size of the required heat transfer area by as much as 50 to 60%.

Disadvantages of conventional subwater heat transfer structures also occur when a first propeller is indirectly driven by a second propeller in the outlet for cooled/heated fluid. The indirect connection increases the cost and decreases the reliability of the structure. The indirect connection increases the amount of parts and energy needed to operate the structure and makes the structure more susceptible to system failure.

A need exists for improved technology, including technology that may address one or more of the above described disadvantages of conventional subwater heat transfer structures. For example, a need exists for a subwater heat exchanger that at least one of enhances (i.e., increases) the velocity of the cooling/heating fluid, moves the cooling/heating fluid at a substantially constant velocity, and directly drives the mechanism used to assist cooling/heating the process fluid.

SUMMARY

The present disclosure provides a subwater heat exchanger, among other things.

According to one embodiment, a subwater heat exchanger comprises a duct, first coils, a first impeller and a second impeller. The duct is configured to receive a first fluid. The first coils are inside of the duct and are configured to receive a second fluid that is heated or cooled by the first fluid. The first impeller is inside of the duct that is configured to initiate flow of the first fluid around the first coils. The second impeller is inside of the duct and is substantially in line with the first impeller along a duct lateral axis of the duct.

The foregoing has broadly outlined the features of one embodiment of the present disclosure in order that the detailed description that follows may be better understood. Additional features and embodiments will also be described herein.

BRIEF DESCRIPTION OF THE DRAWINGS

These and other features, aspects and advantages of the disclosed embodiments will become apparent from the following description, appending claims and the accompanying exemplary embodiments shown in the drawings, which are briefly described below.

Figure 1:
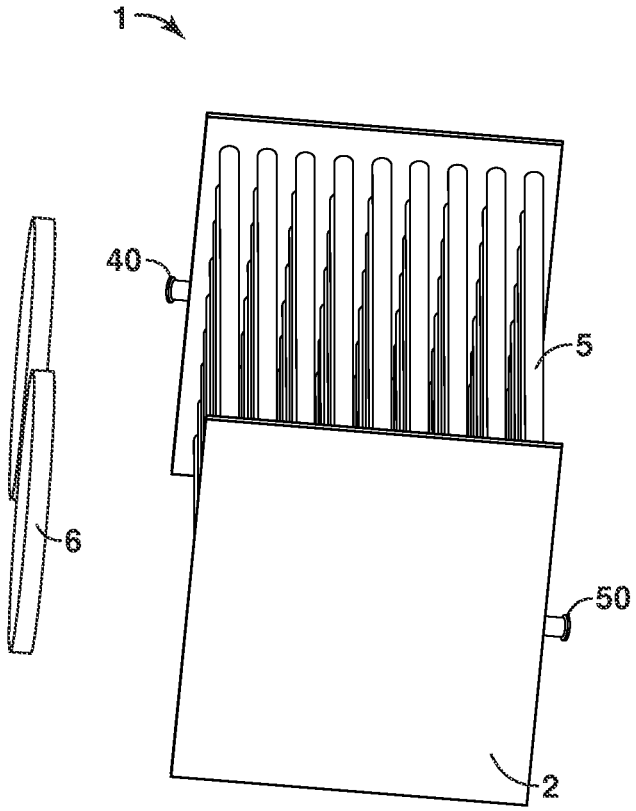
FIG. 1 is a partial schematic of a subwater heat exchanger.

It should be noted that the figures are merely examples of several embodiments of the present disclosure and no limitations on the scope of the present disclosure are intended thereby. Further, the figures are generally not drawn to scale, but are drafted for purposes of convenience and clarity in illustrating various aspects of certain embodiments of the disclosure.

DETAILED DESCRIPTION

For the purpose of promoting an understanding of the principles of the disclosure, reference will now be made to the embodiments illustrated in the drawings and specific language will be used to describe the same. It will nevertheless be understood that no limitation of the scope of the disclosure is thereby intended. Any alterations and further modifications in the described embodiments, and any further applications of the principles of the disclosure as described herein are contemplated as would normally occur to one skilled in the art to which the disclosure relates. Some embodiments of the disclosure are shown in great detail, although it will be apparent to those skilled in the relevant art that some features that are not relevant to the present disclosure may not be shown for the sake of clarity.

Figure 2:
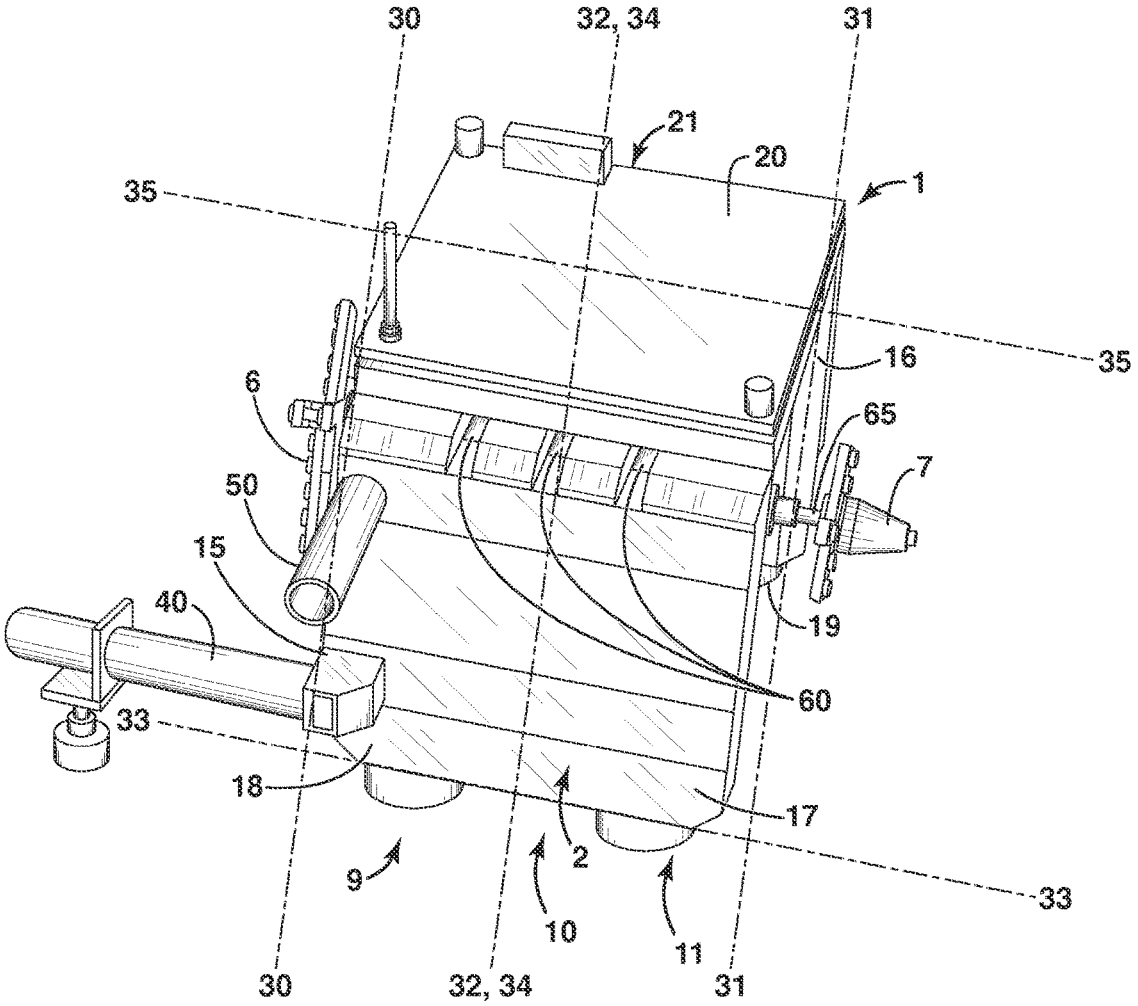
FIG. 2 is a partial schematic of the subwater heat exchanger of FIG. 1.
Figures 3, 4:
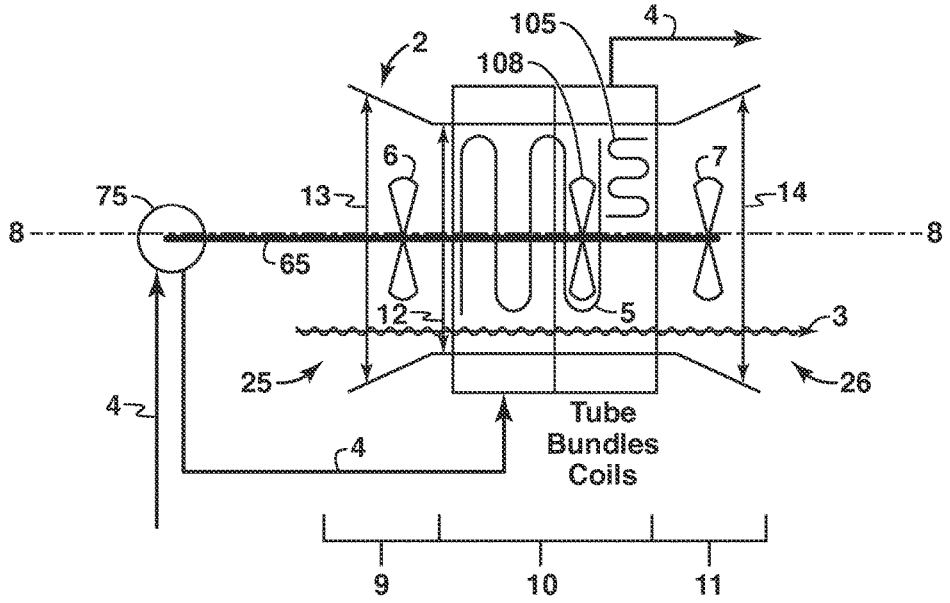
FIG. 3 is a partial schematic of a subwater heat exchanger.
FIG. 4 is a chart comparing total heat transfer for a subwater heat exchangers according to embodiments of this disclosure that have an enhanced subwater velocity to conventional subwater heat exchangers having a conventional subwater velocity.

As shown in FIGS. 1-3, a subwater heat exchanger 1 comprises a duct 2, first coils 5, a first impeller 6 and a second impeller 7. The duct 2 is configured to receive a first fluid 3 (FIG. 3). Specifically, the duct 2 has at least one opening 25 (FIG. 3) that is sized to receive the first fluid 3. The first coils 5, first impeller 6 and second impeller 7 are inside of the duct 2. The first coils 5 are also configured to receive a second fluid 4 (FIG. 3) that is heated or cooled by the first fluid 3. Specifically, the first coils 5 have an opening sized to receive the second fluid 4.

As shown, for example, in FIGS. 2 and 3, the duct 2 may include a first duct portion 9, a second duct portion 11 and a third duct portion 10 that extends from the first duct portion 9 to the second duct portion 11. The first, second and third duct portions 9, 11, 10 may be configured to receive the first fluid 3. Specifically, the first, second and third duct portions 9, 11, 10 may be sized to receive the first fluid 3.

The first duct portion 9 may have a first duct portion width 13, the second duct portion 11 may have a second duct portion width 14 and the third duct portion may have a third duct portion width 12 (i.e., center width). The first duct portion width 13, second duct portion width 14 and third duct portion width 12 may be substantially the same, such as shown in FIG. 2, or the third duct portion width 12 may be smaller than the first duct portion width 13 and the second duct portion width 14, such as shown in FIG. 3, in a direction that is substantially perpendicular to the duct lateral axis 8 (FIG. 3). When the first, second and third duct portion widths 13, 14, 12 are substantially the same, the duct 2 may be rectangular shaped (FIG. 2) and when the third duct portion width 12 is smaller than the first and second duct portion widths 13, 14, the duct 2 may comprise a shape that resembles a venturi channel (FIG. 3).

When the shape of the duct 2 resembles a venturi channel, the subwater heat exchanger 1 allows for a lower overall pressure drop through the heat exchanger 1 then when the first, second and third duct portion widths 13, 14, 12 are substantially the same and the heat exchanger 1 takes advantage of pressure recovery in a discharge plenum 11 (i.e., second duct portion 11) of the duct 2.

The first coils 5 may be inside of the third duct portion 10 so that the first coils 5 are located in the highest velocity region of the first fluid 3 by virtue of the narrower width of the of the third duct portion width 12 relative to the first and second duct portion widths 13, 14. This causes the velocity of the first fluid 3 to be greater at the third duct portion 10 than the first and second duct portions 9, 11.

When the duct 2 resembles a venturi channel, the first impeller 6 may be inside of the first duct portion 9 and/or the third duct portion 10. Moreover, the second impeller 7 may be inside of the second duct portion 11 and/or the third duct portion 10.

The duct 2 may also include a first duct end 15, a second duct end 16, a third duct end 17, a fourth duct end 18, a fifth duct end 19 and a sixth duct end 20. The first and second duct ends 15, 16 may be permeable to the first fluid 3. Moreover, the first duct end 15 may be at an end of the first duct portion 9, which may be at the opening 25 of the duct 2 (FIG. 3), and the second duct end 16 may be at an end of the second duct portion 11, which may be at the opening 26 of the duct 2 (FIG. 3). The first duct end 15 may include a first duct end 15 longitudinal axis 30-30 that is substantially parallel to a second duct end longitudinal axis 31-31 of the second duct end 16 (FIG. 2). The first and second duct end longitudinal axes 30-30, 31-31 may be substantially perpendicular to third, fourth, fifth and sixth duct end longitudinal axes 32-32, 33-33, 34-34, 35-35 of the third, fourth, fifth and sixth duct ends 17, 18, 19, 20, respectively (FIG. 2).

The third duct end 17, fourth duct end 18, fifth duct end 19 and sixth duct end 20 may form an enclosure 21 around the first duct end 15 and the second duct end 16 such that the third, fourth, fifth and sixth duct ends 17, 18, 19, 20 are substantially or completely impermeable to the first fluid 3. Unlike conventional subwater heat exchangers, the partially enclosed nature of the subwater heat exchanger 1 due to the first and second duct ends 15, 16 being substantially permeable to the first fluid 3 and the third, fourth, fifth and sixth duct ends 17, 18, 19, 20 being substantially or completely impermeable to the first fluid 3 creates a direct-line channel for the first fluid 3, thereby improving uniform flow across the coils. In addition to the third, fourth, fifth and sixth duct ends 17, 18, 19, 20 being substantially or completely impermeable to the first fluid 3, these ends 17, 18, 19, 20 are also substantially or completely impermeable to all fluids.

When the third, fourth, fifth and sixth duct ends 17, 18, 19, 20 are substantially impermeable to the first fluid 3 and other fluids, one or more of the third, fourth, fifth and sixth duct ends 17, 18, 19, 20 may include one or more openings 60 (FIG. 2). The opening(s) 60 may draw fresh first fluid 3 or other fluid into the duct 2, thereby enhancing heat transfer within and along the length (i.e., the direction along the lateral axis 8) of the duct 2 by mixing the first fluid 3 already in the duct 2 (i.e., first fluid 3 that enters the duct 2 through the opening 25 in the first duct end 15) with the fresh first fluid 3 or other fluid that enters the duct 2 through the opening(s) 60.

The first coils 5, first impeller 6 and second impeller 7 are inside of the duct 2 (FIG. 3). FIGS. 1-2 merely show a partial schematic of a subwater heat exchanger that does not show the first impeller 6 and/or second impeller 7 inside of the duct 2 so that examples of the first impeller 6 and/or second impeller 7 are visible.

The first coils 5 are configured to receive a second fluid 4 that is heated or cooled by the first fluid 3. Specifically, the first coils 5 include an opening sized to receive a second fluid 4. The first fluid 3 may be any suitable fluid. For example, the first fluid 3 may be water, such as seawater or lake water. The second fluid 4 may be any suitable process fluid that is not the same as the first fluid 3. Examples of the second fluid 4 include, but are not limited to, a gas, a fluid that is condensing or a fluid injected into a well.

The first impeller 6 is configured to initiate flow of the first fluid 3 around the first coils 5. Specifically, the first impeller 6 is driven by a driver 75 of the subwater heat exchanger 1 (FIG. 3) that allows the first impeller 6 to increase the fluid flow of the first fluid 3 around the first coils 5. The driver 75 may directly connect to the first impeller 6 to simplify the construction of the subwater heat exchanger 1 and to increase the operational reliability. Operational reliability can be increased because there are less parts in the system and there are no remote fixtures and associated connections that can fail.

The driver 75 may be any suitable driver. For example, the driver may be the second fluid 4, a third fluid or a magnetic hydrodynamic drive system. When the driver 75 comprises the second fluid 4, the second fluid 4 is different from the first fluid 3 and the second fluid 4 both drives the first impeller 6 and travels through the first coils 5. When the driver 75 comprises a third fluid, the third fluid is different from the first and second fluids 3, 4. The third fluid does not travel through the first coils 5 and is not the second fluid 4 that is cooled or heated by the first fluid 3.

The third fluid may comprise any suitable fluid that is not the first or second fluid 3, 4. For example, the third fluid may comprise a liquid (e.g., water) pumped into an injection well, gas pumped into an injection well, fluid downstream of a compressor, fluid that is an opposite phase from a fourth fluid that is used in an upstream separator, or fluid from a separate production well. Alternatively, if the subwater heat exchanger 1 is upstream of a compressor or an anti-surge loop, then the third fluid may be a higher gas downstream of the compressor or anti-surge loop. In general, the third fluid may be any fluid that is part of a subwater production system.

The second impeller 7 may be substantially in-line with the first impeller 6 along the duct lateral axis 8. A shaft 65 of the subwater heat exchanger 1 may connect the first impeller 6 to the second impeller 7 so that the second impeller 7 is substantially in-line with the first impeller 6 along the duct lateral axis 8. The second impeller 7 is able to recover energy from the first fluid 3 exiting the duct 2 because the second impeller 7 is substantially in-line with the first impeller 6. The ability of the second impeller 7 to recover energy reduces the total amount of energy that the driver 75 must create to driver the first impeller 6. Although the second impeller 7 may be inside of the second or third duct portion 11, 10 of the duct 2, preferably the second impeller 7 is inside of the second duct portion 11 so that the second impeller 7 is at or close to the outlet of the duct 2. Regardless of what duct portion holds the second impeller 7, the second impeller 7 must be located inside of the structure that comprises the outlet of the duct 2 so that the first fluid 3 cannot bypass the second impeller 7. If the second impeller 7 is outside of the structure that comprises the outlet of the duct 2, the first fluid 3 may bypass the second impeller 7, therefore preventing the second impeller 7 from being able to recover energy from the first fluid 3 exiting the duct 2.

The second impeller 7 is driven by the same element that drives the first impeller 6. Specifically, like the first impeller 6, the second impeller 7 is driven by the driver 75. The second impeller 7 must be driven by the same element that drives the first impeller 6 so that the second impeller 7 can recover energy from the first fluid 3 before the energy dissipates to the fluid beyond the subwater heat exchanger 1. As a result of the first and second impellers 6, 7 being driven by the driver 75 such that the second impeller 7 recovers energy from the first fluid 3, the driver 75 uses less energy to turn the two-propeller structure than if the driver 75 only drove the first impeller 6.

The subwater heat exchanger 1 may also include second coils 105 (FIG. 3). The second coils 105 may be inside of the duct 2 and are separate from the first coils 5. The second coils 105 are configured to receive a third fluid (not shown) that is one of a same fluid and a different fluid from the second fluid 4. Specifically, the second coils 105 may include an opening that is sized to receive the third fluid. The third fluid may be any suitable type of process fluid, such as seawater or lake water. The presence of the second coils 105 allows one subwater heat exchanger 1 to cool or heat multiple process fluids in separate coils.

The subwater heat exchanger 1 may also include a third impeller 108 inside of the duct 2 and between the first impeller 6 and the second impeller 7 (FIG. 3). The third impeller 108 may include one or more impellers. The presence of the third impeller 108 between the first impeller 6 and the second impeller 7 helps to enhance the flow, heat transfer and energy efficiency more than in a case where the subwater heat exchanger 1 only includes first and second impellers 6, 7. In addition to being between the first and second impellers 6, 7, the third impeller 108 may be at least one of within and between the first coils 5. When the subwater heat exchanger 1 also includes second coils 105, the third impeller 108 may additionally be at least one of within and between the second coils 105. Moreover, the third impeller(s) 108 may connect to the first and second impeller 6, 7 via the shaft 65 and/or may be driven by the driver 75.

The subwater heat exchanger 1 may also include a plurality of first impellers 6 and/or a plurality of second impellers 7. The increased amount of first impellers 6 helps to further enhance the flow, heat transfer and energy efficiency. The size of the subwater heat exchanger 1 may affect the number of first and second impellers 6, 7 in the subwater heat exchanger 1. For example, the larger the subwater heat exchanger 1, the greater the amount of first and second impellers 6, 7 in the subwater heat exchanger 1 may be to efficiently impart an enhanced flow onto the coils inside of the duct 2. One or more of the first impellers 6 and/or second impellers 7 may be the same or different size and/or configuration from the other one or more first impellers 6 and/or second impellers 7.

Moreover, the subwater heat exchanger 1 may include a duct inlet channel 40 and a duct outlet channel 50 (FIGS. 1-2). The duct inlet channel 40 may be configured to receive the second fluid 4 before the second fluid 4 enters the first coils 5 and the duct outlet channel 50 may be configured to receive the second fluid 4 after the second fluid 4 exits the first coils 5. Specifically, the duct inlet channel 40 and the duct outlet channel 50 may each include an opening sized to receive the second fluid 4. The duct inlet channel 40 and the duct outlet channel 50 may extend from the duct 2. The duct inlet channel and duct outlet channel 50 may be any suitable outlet, such as a nozzle. While FIGS. 1-2 show the duct inlet and outlet channels 40, 50 on the sides of the subwater heat exchanger 1, the duct inlet and outlet channels 40, 50 may be at the top and bottom of the subwater heat exchanger 1, respectively, or any other portion of the subwater heat exchanger 1 as dictated by the final thermal and hydraulic design of the subwater heat exchanger 1.

As shown in FIG. 4, the total heat transfer area required for the subwater heat exchanger 1 discussed in the present disclosure is smaller than the total heat transfer area required for a conventional subwater heat exchanger. In all of the examples shown in FIG. 4, the conventional subwater heat exchanger can only experience a velocity of 0.01 m/s while the subwater heat exchanger 1 can produce a greater velocity, such as a velocity of 1.03 m/s. The greater velocity of the subwater heat exchanger 1 may be more or less than 1.03 m/s. The maximum velocity that can be reached by the subwater heat exchanger 1 is limited by balancing the available power needed to drive driver 75, which is derived from capturing energy from fluids. As a result of the enhanced velocity achieved by the subwater heat exchanger 1, the total heat transfer area for the subwater heat exchanger 1 is significantly smaller than that of the conventional subwater heat exchanger. For example, Unit A displays that the heat transfer area for the conventional subwater heat exchanger is 319 $m^2$ while that of the subwater heat exchanger 1 is 149 $m^2$ for the same condensing process, Unit B displays that the heat transfer area for the conventional subwater heat exchanger is 7310 $m^2$ while that of the subwater heat exchanger 1 is 1959 $m^2$ for the same condensing process, Unit C displays that the heat transfer area for the conventional subwater heat exchanger is 365 $m^2$ while that of the subwater heat exchanger 1 is 231 $m^2$ for the same condensing process, Unit D displays that the heat transfer area for the conventional subwater heat exchanger is 536 $m^2$ while that of the subwater heat exchanger 1 is 273 $m^2$ for the same condensing process, Unit E displays that the heat transfer area for the conventional subwater heat exchanger is 346 $m^2$ while that of the subwater heat exchanger 1 is 122 $m^2$ for the same condensing process and Unit F displays that the heat transfer area for the conventional subwater heat exchanger is 2176 $m^2$ while that of the subwater heat exchanger 1 is 824 $m^2$ for the same cooling process. The duty for Units A-E is 936 kW, 58827 kW, 893 kW, 1601 kW, 1146 kW and 11227 kW, respectively.

FIG. 4 also shows the EMTD, which represents the effective mean temperature difference. The effective mean temperature difference represents a calculated value determined via an incremental analysis of heat transfer across a subwater heat exchanger along a width, length and height of the subwater heat exchanger. The EMTD is different from the LMTD. The LMTD is based on a global inlet and outlet temperature of the fluid (i.e., process fluid) processed by the subwater heat exchanger.

Figure 5A:
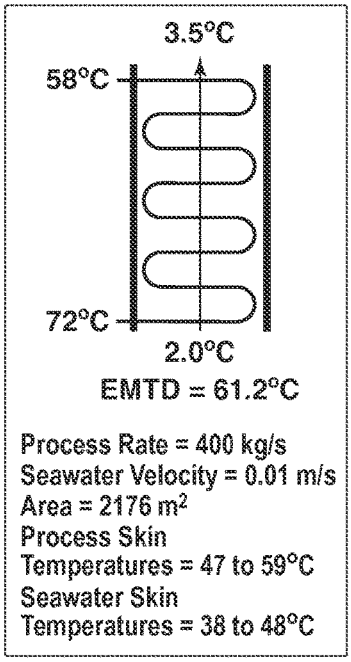
FIG. 5*a* shows heat transfer properties for a conventional subwater heat exchanger.
Figure 5B:
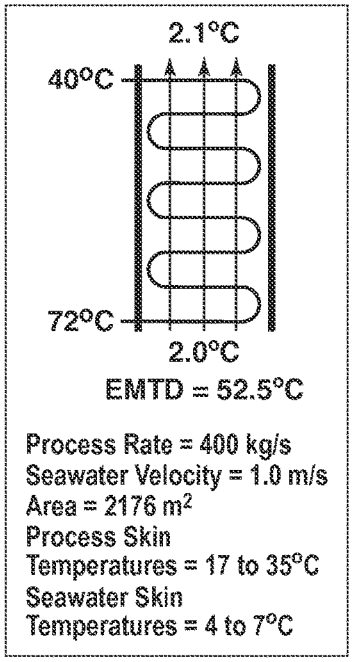
FIG. 5*b* shows heat transfer properties for a subwater heat exchanger according to one of the embodiments of this disclosure.
Figure 5C:
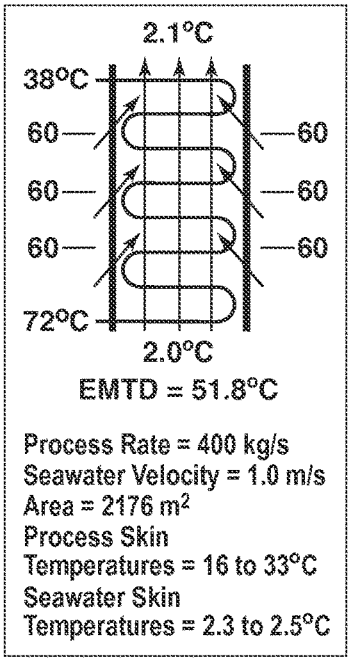
FIG. 5*c* shows heat transfer properties for a subwater heat exchanger according to one of the embodiments of this disclosure.

As shown in FIGS. 5*a*-5*c*, the process and first fluid skin temperatures of a subwater heat exchanger are lower for the subwater heat exchanger 1 than that of a conventional subwater heat exchanger. FIG. 5*a* shows heat transfer effects for a conventional subwater heat exchanger, FIG. 5*b* shows heat transfer effects for a subwater heat exchanger 1 without openings 60 in one or more of the third, fourth, fifth and sixth duct ends 17, 18, 19, 20 and FIG. 5*c* shows heat transfer effects for a subwater heat exchanger 1 with openings 60 in one or more of the third, fourth, fifth and sixth duct ends 17, 18, 19, 20. The area and process rate of each of the subwater heat exchangers shown in FIGS. 5*a*-5*c* is the same, 2176 $m^2$ and 400 kg/s, respectively. But the velocity of the first fluid in FIG. 5*a* is different from that in FIGS. 5*b*-5*c*, thereby resulting in different process and first fluid skin temperatures. The velocity of the first fluid in FIG. 5*a* is only 0.01 m/s while the velocity of the first fluid in FIGS. 5*b* and 5*c* is 1.0 m/s. As a result, the process and first fluid skin temperatures for the conventional subwater heat exchanger in FIG. 5*a* ranges from 47 to 59 degrees C. and 38 to 48 degrees C., respectively, the process and first fluid skin temperatures for the subwater heat exchanger in FIG. 5*b* ranges from 17 to 35 degrees C. and 4 to 7 degrees C., respectively, and the process and first fluid skin temperatures for the subwater heat exchanger in FIG. 5*c* ranges from 16 to 33 degrees C. and 2.3 to 2.5 degrees C., respectively. The process skin temperature is the temperature at the inside surface of the coils and the first fluid skin temperature is the temperature at the outside surface of the coils.

Disclosed aspects may be used in hydrocarbon management activities. As used herein, "hydrocarbon management" or "managing hydrocarbons" includes hydrocarbon extraction, hydrocarbon production, hydrocarbon exploration, identifying potential hydrocarbon resources, identifying well locations, determining well injection and/or extraction rates, identifying reservoir connectivity, acquiring, disposing of and/or abandoning hydrocarbon resources, reviewing prior hydrocarbon management decisions, and any other hydrocarbon-related acts or activities. The term "hydrocarbon management" is also used for the injection or storage of hydrocarbons or $CO_2$ for example the sequestration of $CO_2$, such as reservoir evaluation, development planning, and reservoir management. In one embodiment, the disclosed methodologies and techniques may be used to extract hydrocarbons from a subsurface region. In such an embodiment, inputs are received from one or more sensors in the subwater heat exchanger 1. Based at least in part on the received inputs, a reduction in flow assurance concerns of an extracted hydrocarbons can occur, a reduction in pipeline length and/or line sizing for the pipe that receives the hydrocarbons can occur, smaller topside facilities for the hydrocarbon system can occur or reduced energy loss from multiphase flow in the pipeline(s) that receives the hydrocarbon can occur. Hydrocarbon extraction may then be conducted to remove hydrocarbons from the subsurface region, which may be accomplished by drilling a well using oil drilling equipment. The equipment and techniques used to drill a well and/or extract the hydrocarbons are well known by those skilled in the relevant art. Other hydrocarbon extraction activities and, more generally, other hydrocarbon management activities, may be performed according to known principles.

Figure 6:
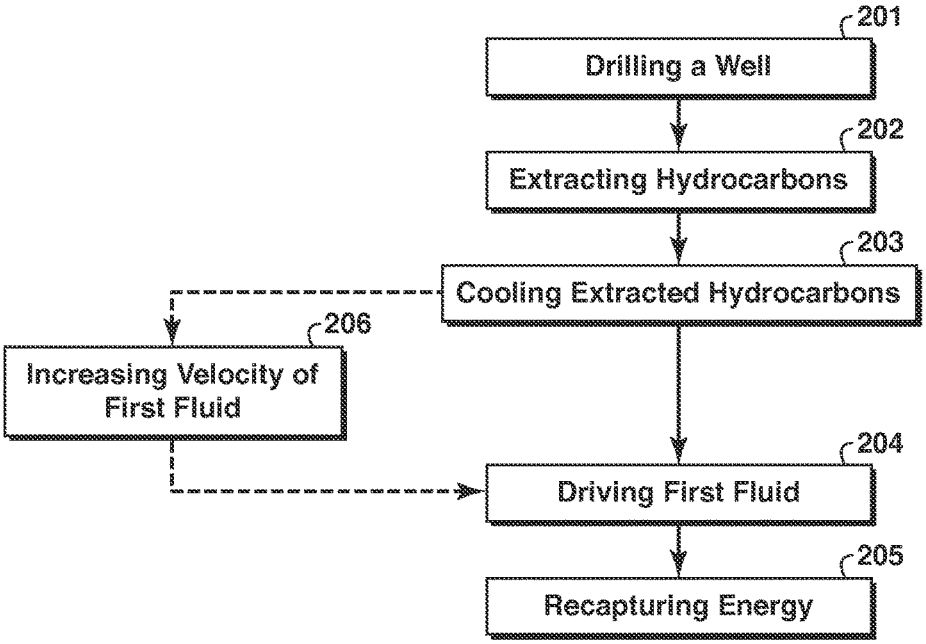
FIG. 6 is a flowchart of a method of producing hydrocarbons.

As shown in FIG. 6, a method of producing hydrocarbons may include drilling a well using drilling equipment 201, extracting hydrocarbons from the well 202 and cooling the extracted hydrocarbons 203. Cooling the extracted hydrocarbons 203 may include directly driving the first fluid 3 around coils within the duct 2 at least at a substantially increased and constant velocity 206 using the driver 75 and the first impeller 6. Cooling the extracted hydrocarbons 203 may also include partially recapturing energy 205 from the first fluid 3, 205 to reduce the amount of energy that the driver 75 needs to create to drive the first impeller 6. The second impeller 7 may partially recapture the energy. Additionally, the method may include increasing the velocity of the first fluid 3, 206 before driving the first fluid 3, 204 around the coils within the duct 2 at least at the substantially constant velocity.

Persons skilled in the technical field will readily recognize that in practical applications of the disclosed method of producing a hydrocarbon, one or more steps must be performed on a computer, typically a suitably programmed digital computer. Further, some portions of the detailed descriptions which follow are presented in terms of procedures, steps, logic blocks, processing and other symbolic representations of operations on data bits within a computer memory. These descriptions and representations are the means used by those skilled in the data processing arts to most effectively convey the substance of their work to others skilled in the art. In the present application, a procedure, step, logic block, process, or the like, is conceived to be a self-consistent sequence of steps or instructions leading to a desired result. The steps are those requiring physical manipulations of physical quantities. Usually, although not necessarily, these quantities take the form of electrical or magnetic signals capable of being stored, transferred, combined, compared, and otherwise manipulated in a computer system.

It should be borne in mind, however, that all of these and similar terms are to be associated with the appropriate physical quantities and are merely convenient labels applied to these quantities. Unless specifically stated otherwise as apparent from the following discussions, it is appreciated that throughout the present application, discussions utilizing the terms such as "processing" or "computing," "calculating," "determining," "displaying," "copying," "producing," "storing," "accumulating," "adding," "applying," "identifying," "consolidating," "waiting," "including," "executing," "maintaining," "updating," "creating," "implementing," "generating" or the like, refer to the action and processes of a computer system, or similar electronic computing device, that manipulates and transforms data represented as physical (electronic) quantities within the computer system's registers and memories into other data similarly represented as physical quantities within the computer system memories or registers or other such information storage, transmission or display devices.

It is important to note that the steps depicted in FIG. 6 are provided for illustrative purposes only and a particular step may not be required to perform the inventive methodology. The claims, and only the claims, define the inventive system and methodology.

Embodiments of the present disclosure also relate to an apparatus for performing the operations herein. This apparatus may be specially constructed for the required purposes, or it may comprise a general-purpose computer selectively activated or reconfigured by a computer program stored in the computer. Such a computer program may be stored in a computer readable medium. A computer-readable medium includes any mechanism for storing or transmitting information in a form readable by a machine (e.g., a computer). For example, but not limited to, a computer-readable (e.g., machine-readable) medium includes a machine (e.g., a computer) readable storage medium (e.g., read only memory ("ROM"), random access memory ("RAM"), magnetic disk storage media, optical storage media, flash memory devices, etc.), and a machine (e.g., computer) readable transmission medium (electrical, optical, acoustical or other form of propagated signals (e.g., carrier waves, infrared signals, digital signals, etc.). The computer-readable medium may be non-transitory.

Furthermore, as will be apparent to one of ordinary skill in the relevant art, the modules, features, attributes, methodologies, and other aspects of the disclosure can be implemented as software, hardware, firmware or any combination of the three. Of course, wherever a component of the present disclosure is implemented as software, the component can be implemented as a standalone program, as part of a larger program, as a plurality of separate programs, as a statically or dynamically linked library, as a kernel loadable module, as a device driver, and/or in every and any other way known now or in the future to those of skill in the art of computer programming. Additionally, the present disclosure is in no way limited to implementation in any specific operating system or environment.

The following lettered paragraphs represent non-exclusive ways of describing embodiments of the present disclosure.

A: A subwater heat exchanger includes a duct configured to receive a first fluid, first coils inside of the duct, the first coils configured to receive a second fluid that is heated or cooled by the first fluid, a first impeller inside of the duct that is configured to initiate flow of the first fluid around the first coils; and a second impeller inside of the duct and substantially in line with the first impeller along a duct lateral axis of the duct.

A1: The subwater heat exchanger according to A, wherein the duct includes a first duct portion configured to receive the first fluid; a second duct portion configured to receive the first fluid; and a third duct portion extending from the first duct portion to the second duct portion and having a center width that is one of substantially the same and smaller than a first duct portion width of the first duct portion and a second duct portion width of the second duct portion in a direction that is substantially perpendicular to the duct lateral axis, wherein the first coils are inside of the third duct portion.

A2: The subwater heat exchanger according to A1, wherein the first impeller is inside of at least one of the first duct portion and the third duct portion, and wherein the second impeller is inside of at least one of the second duct portion and the third duct portion.

A3: The subwater heat exchanger according to A1 or A2, wherein the duct further includes a first duct end and a second duct end that are permeable to the first fluid, the first duct end being at an end of the first duct portion and the second duct end being at an end of the second duct portion; and a third duct end, a fourth duct end, a fifth duct end and a sixth duct end that form an enclosure around the first duct end and the second duct end.

A4: The subwater heat exchanger according to A3, wherein a first duct end longitudinal axis of the first duct end is substantially parallel to a second duct end longitudinal axis of the second duct end, and wherein the first and second duct end longitudinal axes are substantially perpendicular to third, fourth, fifth and sixth duct end longitudinal axes of the third, fourth, fifth and sixth duct ends.

A5: The subwater heat exchanger according to A3 or A4, wherein at least one of the third, fourth, fifth and sixth duct ends includes an opening that receives the first fluid.

A6: The subwater heat exchanger according to A3 or A4, wherein at least of the third, fourth, fifth and sixth duct ends includes multiple openings that receive the first fluid.

A7: The subwater heat exchanger according to any of the preceding claims, further comprising second coils inside of the duct that are separate from the first coils.

A8: The subwater heat exchanger according to A7, wherein the second coils are configured to receive a third fluid that is one of a same fluid and a different fluid from the second fluid.

A9: The subwater heat exchanger according to any of the preceding claims, wherein the first fluid comprises water.

A10: The subwater heat exchanger according to A8, wherein the second fluid and the third fluid comprise process fluid.

A11: The subwater heat exchanger according to any of the preceding claims, further comprising a shaft that connects the first impeller to the second impeller.

A12: The subwater heat exchanger according to any of the preceding claims, further comprising a third impeller inside the duct and between the first impeller and the second impeller.

A13: The subwater heat exchanger according to A12, wherein the shaft connects the third impeller to the first impeller and the second impeller.

A14: The subwater heat exchanger according to A12 or A13, wherein the third impeller comprises a plurality of third impellers.

A15: The subwater heat exchanger according to A12, A13 or A14, wherein the third impeller is at least one of within and between the first coils.

A16: The subwater heat exchanger according to any of the preceding claims, further comprising a driver that drives at least one of the first impeller and the second impeller, wherein the driver directly connects to the first impeller.

A17: The subwater heat exchanger according to A16, wherein the driver comprises the second fluid and the first fluid is different from the second fluid.

A18: The subwater heat exchanger according to A16 or A17, wherein the driver comprises one of a third fluid that is different from the first fluid and the second fluid.

A19: The subwater heat exchanger according to A8, A9, A10 or A18, wherein the third fluid comprises one of (a) liquid pumped into an injection well, (b) gas pumped into an injection well, (c) fluid downstream of a compressor, and (d) an opposite phase from a fourth fluid used in an upstream separator.

A20: The subwater heat exchanger according to A19, wherein the liquid comprises water.

A21: The subwater heat exchanger according to A16, A17, A18, A19 or A20 wherein the drives comprises a magnetic hydrodynamic system.

A22: The subwater heat exchanger according to any of the preceding claims, further comprising a duct inlet channel and a duct outlet channel, wherein the duct inlet channel is configured to receive the second fluid before the second fluid enters the first coils and the duct outlet channel is configured to receive the second fluid after the second fluid exits the first coils.

B: A method of producing hydrocarbons comprises drilling a well using drilling equipment; extracting hydrocarbons from the well; cooling the extracted hydrocarbons by: directly driving a first fluid around coils within a duct at least at a substantially constant velocity using a driver and a first impeller, and recapturing energy from the first fluid to reduce energy created by the driver.

B1: The method of claim B, further comprising increasing a velocity of the first fluid before driving the first fluid around the coils within the duct at least at the substantially constant velocity.

As utilized herein, the terms "approximately," "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numeral ranges provided. Accordingly, these terms should be interpreted as indicating that insubstantial or inconsequential modifications or alterations of the subject matter described and are considered to be within the scope of the disclosure.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

It should be understood that the preceding is merely a detailed description of specific embodiments of this disclosure and that numerous changes, modifications, and alternatives to the disclosed embodiments can be made in accordance with the disclosure here without departing from the scope of the disclosure. The preceding description, therefore, is not meant to limit the scope of the disclosure. Rather, the scope of the disclosure is to be determined only by the appended claims and their equivalents. It is also contemplated that structures and features embodied in the present examples can be altered, rearranged, substituted, deleted, duplicated, combined, or added to each other.

The articles "the", "a" and "an" are not necessarily limited to mean only one, but rather are inclusive and open ended so as to include, optionally, multiple such elements.

What is claimed is:

1. A subwater heat exchanger comprising:

a duct configured to receive a first fluid;

first coils inside of the duct, the first coils configured to receive a second fluid that is heated or cooled by the first fluid;

a first impeller inside of the duct that is configured to initiate flow of the first fluid around the first coils; and a second impeller inside of the duct and substantially in line with the first impeller along a duct lateral axis of the duct;

wherein the duct includes a first duct portion configured to receive the first fluid, a second duct portion configured to receive the first fluid, and a third duct portion extending from the first duct portion to the second duct portion and having a center width that is one of substantially the same and smaller than a first duct portion width of the first duct portion and a second duct portion width of the second duct portion in a direction that is substantially perpendicular to the duct lateral axis, wherein the first coils are inside of the third duct portion;

wherein the duct further includes a first duct end and a second duct end that are permeable to the first fluid, the first duct end being at an end of the first duct portion and the second duct end being at an end of the second duct portion, and a third duct end, a fourth duct end, a fifth duct end and a sixth duct end that form an enclosure around the first duct end and the second duct end;

wherein at least one of the third, fourth, fifth and sixth duct ends includes one or more openings that receive the first fluid.

2. The subwater heat exchanger of claim 1, wherein the first impeller is inside of at least one of the first duct portion and the third duct portion, and wherein the second impeller is inside of at least one of the second duct portion and the third duct portion.

3. The subwater heat exchanger of claim 1, wherein a first duct end longitudinal axis of the first duct end is substantially parallel to a second duct end longitudinal axis of the second duct end, and wherein the first and second duct end longitudinal axes are substantially perpendicular to third, fourth, fifth and sixth duct end longitudinal axes of the third, fourth, fifth and sixth duct ends.

4. The subwater heat exchanger of claim 1, further comprising second coils inside of the duct that are separate from the first coils.

5. The subwater heat exchanger of claim 4, wherein the second coils are configured to receive a third fluid that is one of a same fluid and a different fluid from the second fluid.

6. The subwater heat exchanger of claim 1, wherein the first fluid comprises water.

7. The subwater heat exchanger of claim 5, wherein the second fluid and the third fluid comprise process fluid.

8. The subwater heat exchanger of claim 1, further comprising a shaft that connects the first impeller to the second impeller.

9. The subwater heat exchanger of claim 8, further comprising a third impeller inside the duct and between the first impeller and the second impeller.

10. The subwater heat exchanger of claim 9, wherein the shaft connects the third impeller to the first impeller and the second impeller.

11. The subwater heat exchanger of claim 9, wherein the third impeller comprises a plurality of third impellers.

12. The subwater heat exchanger of claim 9, wherein the third impeller is at least one of within and between the first coils.

13. The subwater heat exchanger of claim 1, further comprising a driver that drives at least one of the first impeller and the second impeller, wherein the driver directly connects to the first impeller.

14. The subwater heat exchanger of claim 13, wherein the driver comprises the second fluid and the first fluid is different from the second fluid.

15. The subwater heat exchanger of claim 13, wherein the driver comprises one of a third fluid that is different from the first fluid and the second fluid.

16. The subwater heat exchanger of claim 15, wherein the third fluid comprises one of (a) liquid pumped into an injection well, (b) gas pumped into an injection well, (c) fluid downstream of a compressor, and (d) an opposite phase from a fourth fluid used in an upstream separator.

17. The subwater heat exchanger of claim 16, wherein the liquid comprises water.

18. The subwater heat exchanger of claim 13, wherein the driver comprises a magnetic hydrodynamic system.

19. The subwater heat exchanger of claim 1, further comprising a duct inlet channel and a duct outlet channel, wherein the duct inlet channel is configured to receive the second fluid before the second fluid enters the first coils and the duct outlet channel is configured to receive the second fluid after the second fluid exits the first coils.

20. A method of producing hydrocarbons, comprising:

drilling a well using drilling equipment;

extracting hydrocarbons from the well;

using the subwater heat exchanger of claim 1, cooling the extracted hydrocarbons by:

directly driving a first fluid around coils within a duct at least at a substantially constant velocity using a driver and a first impeller, and recapturing energy from the first fluid to reduce energy created by the driver.

21. The method of claim 20, further comprising increasing a velocity of the first fluid before driving the first fluid around the coils within the duct at least at the substantially constant velocity.

* * * * *